US005613912A

United States Patent [19]

Slater

[11] Patent Number: 5,613,912

[45] Date of Patent: Mar. 25, 1997

[54] BET TRACKING SYSTEM FOR GAMING TABLES

[75] Inventor: Timothy J. Slater, South Lake Tahoe, Calif.

[73] Assignee: Harrah's Club, Reno, Nev.

[21] Appl. No.: 417,211

[22] Filed: Apr. 5, 1995

[51] Int. Cl.[6] ..... A63F 9/24

[52] U.S. Cl. ..... 463/25; 463/29; 235/380

[58] Field of Search ..... 273/138 R, 138 A, 273/292, 309, 433–434, 436, DIG. 28; 364/410–412, 401, 406; 235/380; 463/1, 25, 29, 40, 42

[56] References Cited

U.S. PATENT DOCUMENTS

| | | | |
|---|---|---|---|
| 3,909,002 | 9/1975 | Levy | 273/138 A |
| 4,467,424 | 8/1984 | Hedges et al. | 273/138 A |
| 4,531,187 | 7/1985 | Uhland | 364/412 |
| 4,575,622 | 3/1986 | Pellegrini | 273/138 A |
| 4,755,941 | 7/1988 | Bacchi | 364/412 |
| 4,760,527 | 7/1988 | Sidley | 364/412 |
| 4,813,675 | 3/1989 | Greenwood | 273/309 |
| 4,815,741 | 3/1989 | Small | 273/138 A |
| 5,007,641 | 4/1991 | Seidman | 273/138 A |
| 5,038,022 | 8/1991 | Lucero | 273/138 A |
| 5,080,364 | 1/1992 | Seidman | 273/138 A |
| 5,083,271 | 1/1992 | Thacher et al. | 273/DIG. 28 |
| 5,096,195 | 3/1992 | Gimmon | 273/138 A |
| 5,098,107 | 3/1992 | Boylan et al. | 273/309 |
| 5,179,517 | 1/1993 | Sabrin et al. | 364/410 |
| 5,197,094 | 3/1993 | Tillery et al. | 273/434 |
| 5,209,476 | 5/1993 | Eiba | 273/138 A |
| 5,248,142 | 9/1993 | Breeding | 273/292 |
| 5,257,179 | 10/1993 | DeMar | 463/25 |
| 5,257,789 | 11/1993 | LeVasseur | 273/309 |
| 5,265,874 | 11/1993 | Dickinson et al. | 273/138 A |
| 5,287,269 | 2/1994 | Dorrough et al. | 364/408 |
| 5,321,241 | 6/1994 | Craine | 235/380 |
| 5,429,361 | 7/1995 | Raven et al. | 463/25 |
| 5,470,079 | 11/1995 | LeStrange et al. | 463/25 |

OTHER PUBLICATIONS

"PitTrak™Player Tracking System", PRC Gaming Systems, Chico, CA 95928.

Robbins, James, "Radio Helps Casinos Spot Big Spenders", *Reno Gazette–Journal*, Jan. 18, 1995, pp. 1C–3c.

"PRC Player Tracking System Adds 44 Tables", *Central States Gaming*, Apr. 17, 1995, p. 3.

"In–Charge Cards", Electronics Now, Aug. 1993, p. 4.

*Primary Examiner*—Jessica Harrison
*Assistant Examiner*—Mark A. Sager
*Attorney, Agent, or Firm*—Fenwick & West LLP

[57] ABSTRACT

A system is provided for automatically tracking the betting activity of casino patrons at gaming tables and providing an indication of this betting activity to casino personnel in real time. Casino patrons use magnetic cards to check themselves in and out of the bet tracking system through magnetic card readers located at each betting position of a gaming table. Customer identity and location codes are coupled from the gaming table to a computer system using a wireless communication network. The computer system uses the codes to retrieve customer information, to estimate an average bet for the patron based on the current minimum table bet for the gaming table and the time period of the patron's play, and to calculate periodically an average theoretical win based on the patron's play. This information is made available through the casino computer system to casino personnel at the patron's gaming table and at any other gaming table to which the patron moves. The information available to the casino personnel is updated periodically to reflect the patron's accumulated betting activity.

26 Claims, 6 Drawing Sheets

BET TRACKING SYSTEM FOR GAMING TABLES

BACKGROUND OF THE INVENTION

1. Field of the Invention

The present invention relates to the field of gaming, and in particular to systems and methods for monitoring the play of casino patrons at gaming tables to determine the betting activity of the casino patrons.

2. Background Art

Casinos have long recognized the need to build customer loyalty by identifying their regular customers and rewarding them for their patronage. These rewards include complementary drinks, meals, and hotel rooms, with the value of the reward being determined by the betting activity of the customer. Customers are keenly aware of this practice and often consider how well their betting activity is tracked for such rewards when deciding which casino they will patronize.

Systems for automatically tracking the betting activity of slot machine players have been available for some time. These tracking systems are relatively simple to implement since bet amounts are fixed and are already tracked as part of the slot machine's operation. The tracking systems typically provide the patron with a magnetic card which is inserted into a slot machine to identify the patron whose bets are then tracked through the slot machine.

Tracking the betting activity of table game players poses a very different problem since bets are made by placing casino chips or cash on the table, and the croupier monitors the amounts for all patrons. Thus, there is no automated system for tracking the bets of table game players. Moreover, beyond meeting the minimum bet level established at a table, the player's bets are not limited to a few specified values as is the case with slot machines. Traditionally, the betting activity of these players is tracked by the croupier or pit manager, who observes a player over a period of time to estimate the player's betting level. This method is not nearly as accurate as the automatic system employed for slot machines, since it relies on the observational skills of casino personnel who are occupied with a variety of other tasks while on duty. For example, if the pit manager fails to notice when a player arrives or departs from a table game, the pit manager will have to estimate these times. More importantly, there is no convenient way to transfer this information to casino personnel at other gaming tables where the patron may play. As a result, casino patrons who are keenly aware of their betting activity may be disappointed when expected complementary meals or drinks are not forthcoming. Consequently, they may take their patronage elsewhere.

Thus, there is a need for a system and method for tracking the betting activity of card players with a reasonable accuracy and without employing additional personnel to achieve this level of accuracy.

SUMMARY OF THE INVENTION

The present invention is a player-activated system for tracking the betting activity of table game players in real time and providing this information to casino personnel. The system allows casino personnel to reward table game players for their patronage based on up to date information on the players' betting activity. In accordance with the present invention, casino patrons are issued machine-readable identity cards such as magnetically encoded cards to check themselves into the bet tracking system when they arrive at a gaming table and to check themselves out of the bet tracking system when they leave the gaming table. Card readers mounted at each player position of a gaming table read a customer identity code from an inserted card and transmit it to a computer system along with location and time codes provided by the card reader. In the preferred embodiment, a wireless communication system transmits codes from a card reader to the computer system, although other communication systems, including hard-wire and fiber optic systems, may be employed for code transmission.

Customer and gaming table information maintained in data bases in the computer system is accessed using the transmitted codes, and processed to generate a record of the customer's betting activity. The processed information, which includes selected customer information and indications of betting activity, is made available to casino personnel at the gaming table where the patron is playing, through terminals coupled to the computer system. Casino personnel can thus provide more personalized service to their customers and reward these customers based on up to the minute records of their betting activity.

The system includes bet tracking means to estimate a rating for the patron's betting activity based on data specific to the gaming table the patron has selected. In one embodiment of the invention, the average bet is estimated from the minimum bet allowed at the gaming table selected by the player as well as the time period during which the patron is playing. Bet estimates can thus be tailored to reflect historical data on average betting levels correlated to the time of day and day of the week on which the patron is playing. When a customer's betting level varies from the estimated average bet, casino personnel can enter a more appropriate average bet through the local terminal of the computer system. The average bet data is combined with the patron's playing time and certain game specific parameters to determine a rating for the patron based on the casino's theoretical win from the patron's play.

DETAILED DISCUSSION OF THE INVENTION

Figure 1A:
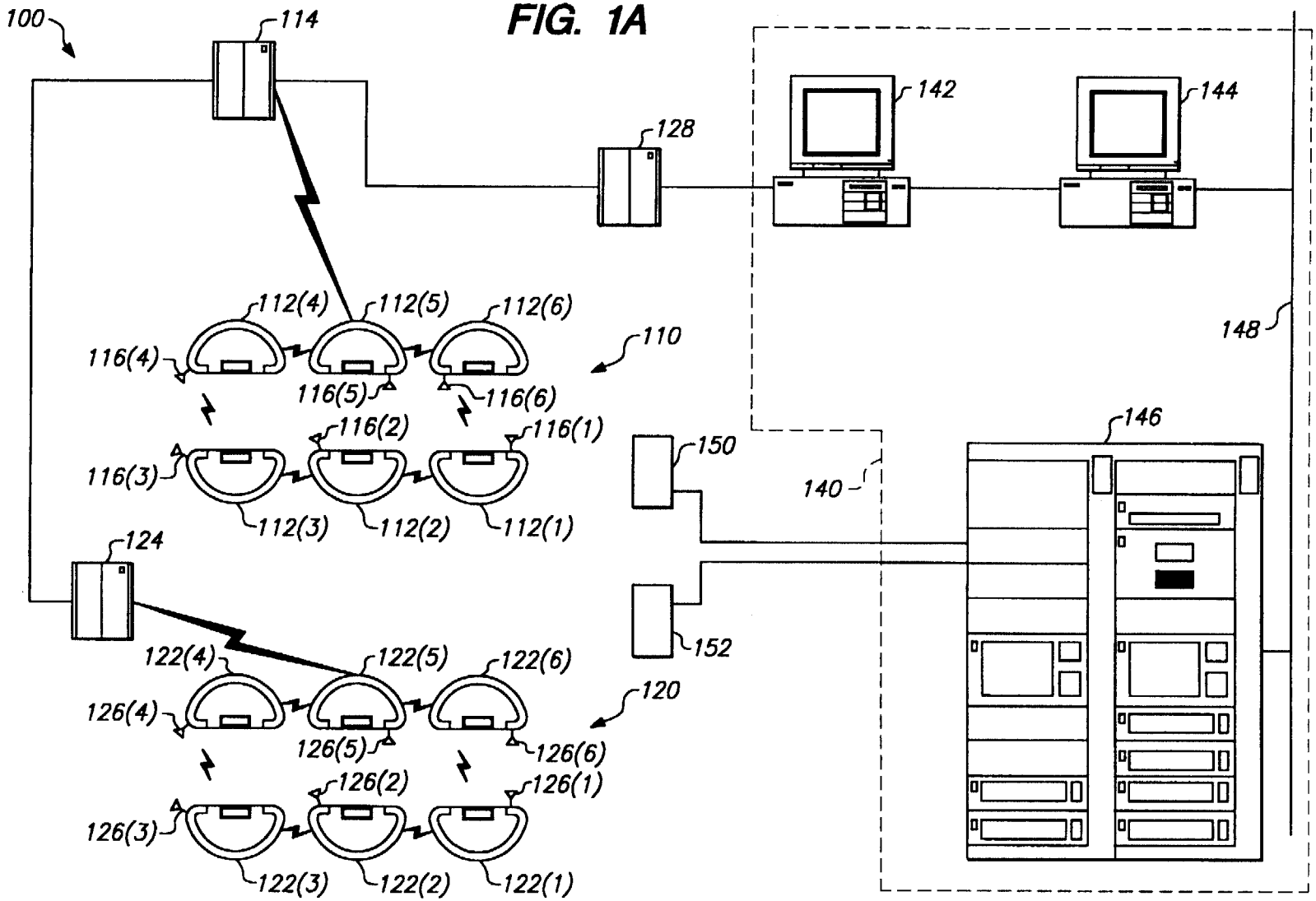
FIG. 1A is a block diagram of an embodiment of the card player bet tracking system in accordance with the present invention.

Referring to FIG. 1A, there is shown an overview of one embodiment of a bet tracking system 100 in accordance with the present invention. For simplicity, bet tracking system 100 is shown comprising first and second pits 110, 120, although it could easily accommodate all of the pits in a casino. Each pit 110, 120 includes six gaming tables 112(1)–112(6), 122(1)–122(6), respectively, which are coupled to associated ceiling transceivers 114, 124 through corresponding table transceivers 116(1)–116(6), 126(1)–126(6). A master transceiver 128 couples data from ceiling transceivers 114, 124 to a computer system 140 for processing.

Gaming tables 112(1)–112(6), 122(1)–122(6) are shown as blackjack tables but they could just as easily be any other gaming tables such as craps tables, roulette tables, or poker tables. In addition, although gaming tables 112(1)–112(6), 122(1)–122(6) are shown coupled to computer system 140 by radio links, bet tracking system 100 could be implemented using any of a variety of data links between tables 112(1)–112(6), 122(1)–122(6) and computer sytem 140, including hard wired and fiber optic connections.

Computer system 140 is shown comprising first and second personal computers (PCs) 142, 144 which are coupled to a system computer 146 through a token ring 148. In the disclosed embodiment, system computer 146 supports a casino management system, which provides a simple means for making information from pit tracking system 100 available throughout the casino. PC 142 serves as an interface between master transceiver 128 and computer system 140, and PC 144 supports the various data bases necessary to implement pit tracking system 100. First and second PCs 142, 144 are employed in computer system 140 principally to facilitate trouble shooting of pit tracking system 100. A simpler configuration could be implemented using, for example, a single PC and system computer or even a system computer alone. Local terminals 150, 152 are provided to pit areas 110, 120 to enable casino personnel to access processed information from system computer 146.

Figure 1B:
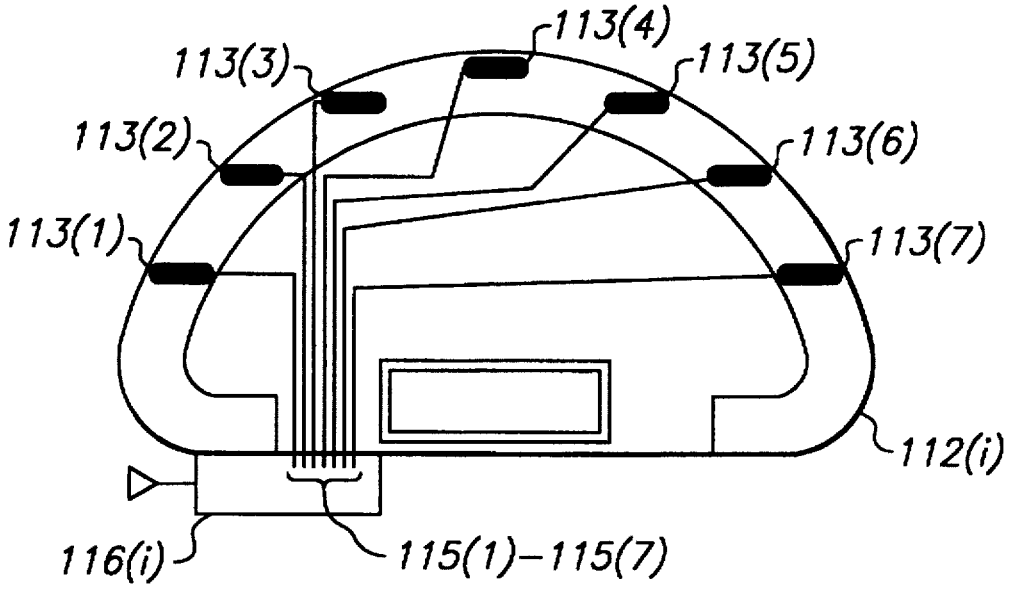
FIG. 1B is a diagram of a gaming table for use in the system of FIG. 1A.

Referring now to FIG. 1B, them is shown a more detailed diagram of a (blackjack) gaming table 112(i) suitable for use with pit tracking system 100. Here, the index 'i' is used to represent any of indices 1–6 corresponding to tables 112(1)–112(6) of FIG. 1A. Gaming table 112(i) typically has seven playing positions, each of which is indicated by an associated card reader 113(1)–113(7). The number of positions is a matter of tradition, and can be increased or decreased as desired without interfering with the operation of pit tracking system 100. Each card reader 113(1)–113(7) is connected to a preassigned slot 115(1)–115(7) of transceiver unit 116(i) in order to associate a specific location code with each card reader 113(1)–113(7).

Referring again to FIG. 1A, transceiver units 116(1)–116(6) in corresponding tables 112(1)–112(6) may act as relays to couple a data signal between a transceiver unit 116(i) and ceiling transceiver 114. For example, transceiver unit 116(2) associated with table 112(2) is coupled to ceiling transceiver 114 through radio links provided by transceiver units 116(3), 116(4), 116(5) of tables 112(3), 112(4), 112(5), respectively. A redundant path between transceiver unit 116(2) and ceiling transceiver 114 is provided through transceiver units 116(1), 116(6), 116(5) of tables 112(1), 112(6), 112(5), respectively. These radio links are flexible and can be readily altered when one or more of transceivers 116(1)–116(6) are not functioning. In the following discussion, indices will be dropped from reference numbers unless they are necessary to refer to specific devices.

Figure 1C:
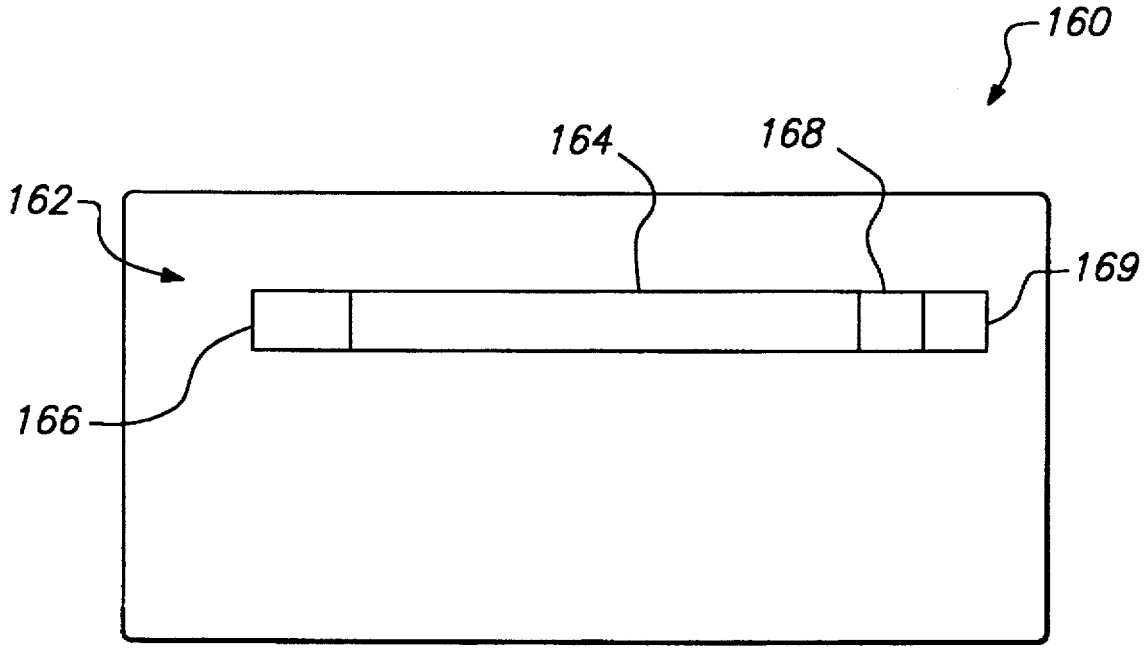
FIG. 1C is a schematic diagram of a magnetic identity card for use in the system of FIGS. 1A and 1B.

Referring now to FIG. 1C, there is shown a magnetic identity card 160 suitable for use in the disclosed embodiment of bet tracking system 100. Magnetic identity card 160 includes a magnetic strip 162 on which is recorded an identity code 164 representing either a customer account number or a programming card function, as discussed below. Identity code 164 is preceded by a start sentinel 166 and follow by an end sentinel 168 and a parity check character 169 to make card reading more dependable. Bet tracking system 100 may be implemented using cards or tokens that support other machine-readable coding formats, such as optical coding formats, and suitable card (token) readers 113.

A card player selects a position at an open table 112 and inserts a magnetic identity card 160 into corresponding card reader 113 to initiate tracking. Identity code 164 is read from magnetic card 160 and transferred to transceiver unit 116, which couples code 164 to computer system 140 along with time and location codes through intervening transceiver units 116, ceiling transceiver 114, and master transceiver 128. Received codes are processed by PCs 142, 144 to generate relevant player information, which is transferred to system computer 146 and made available to casino personnel through local terminal 150. In the disclosed embodiment, local terminal 150 automatically displays player information as it is generated by computer system 140, although system 100 could also operate by having casino personnel call up information at terminal 150 as it is required. Processing of codes by PCs 142, 144 and computer 146 is described in greater detail below.

Figure 2:
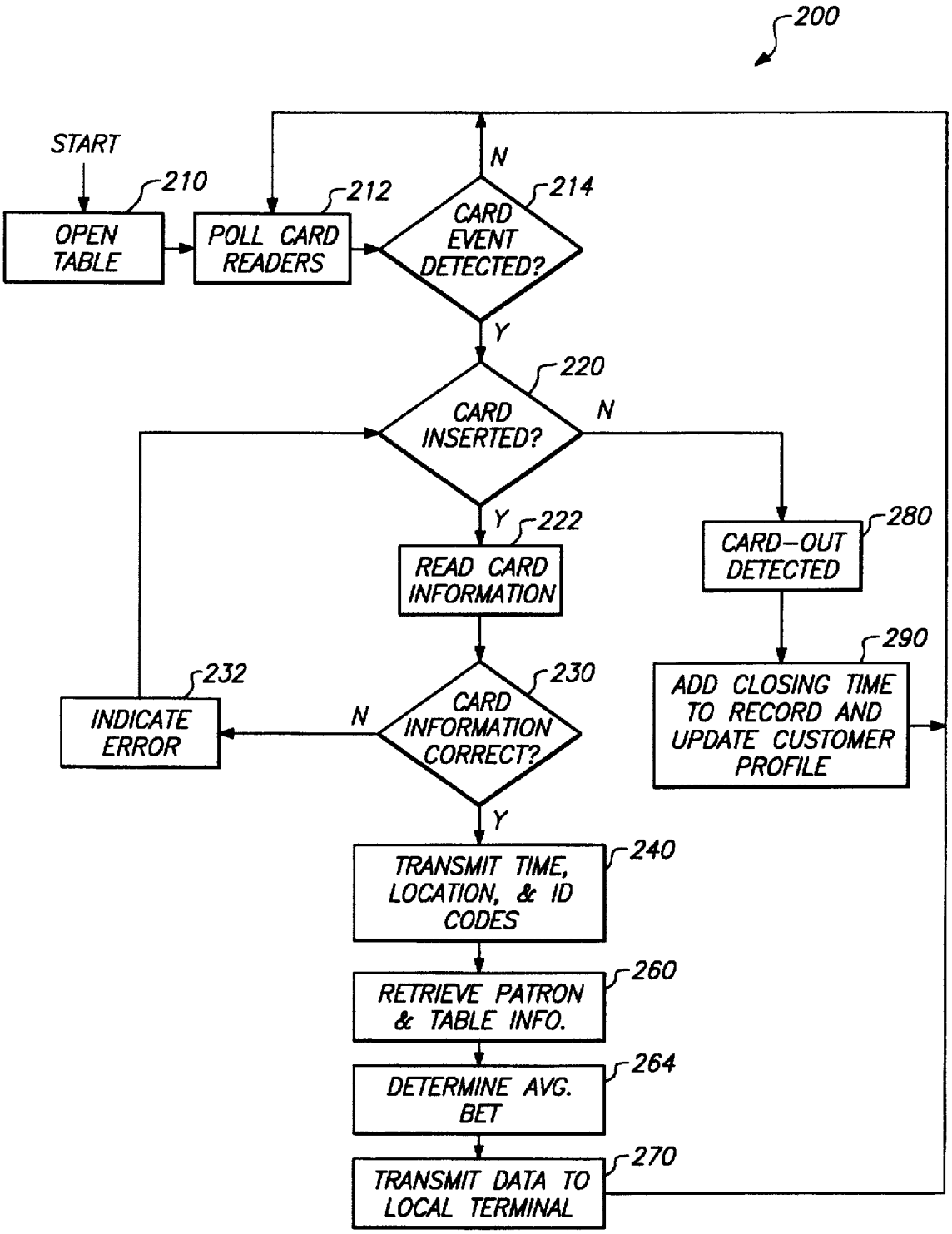
FIG. 2 is a flow chart of an embodiment of the method for tracking card player betting activity in accordance with the present invention.

Referring now to FIG. 2, there is shown a flow chart of a bet tracking process 200 in accordance with the present invention. Process 200 is initialized when a table 112 is opened 210. This is accomplished in the disclosed embodiment by inserting a table-open card into one of card readers 113, as discussed in greater detail below. Card readers 113 at the opened table are polled 212, and when a card event is detected 214 the type of event is determined. If the card event is determined 220 to be a card-insertion, an identity code 164 is read 222 and checked 230 for read errors. If the card information is invalid or the card read failed, process 200 indicates 232 an error condition at card reader 113. Detection 280 of a card-removal event causes an open patron record to be closed and updated, as discussed in greater detail below.

Time and location (table and table position) codes are provided 240 to computer system 140 along with identity code 164. A location code includes a table number and table position, determined by which card reader 113 is transmitting and which slot 115(i) slot of transceiver 116 receives magnetic card data, respectively. The time code identifies the time of the card-insertion or card-removal event and may be provided by a clock in card reader 113 or in any of computers 142, 144, 146.

Computer system 140 uses the customer's identity code 164 and table code to retrieve 260 customer history information and table information, respectively, from data bases maintained in computer system 140. The table information is processed 264 using the time code to determine an average bet for the customer, and the average bet is transmitted 270 along with selected customer history and time information as a bet tracking record to local terminal 150 where it is available for use by casino personnel. The bet tracking record also includes a player rating which reflects a theoretical win for the casino that is based on the average bet and playing time of the patron and selected parameters specific to the game the patron is playing. The rating, which is used by casino personnel to determine when a player has earned a complementary drink, meal, or other reward, is discussed in greater detail below. Card readers 113 are continually polled 212 and when a card out event is detected 280, the betting record is closed 290 and the customer history is updated 290 in the corresponding data base.

In order for system 100 to gain acceptance among casino patrons, it must operate dependably and seamlessly from the patrons' perspective. One key to customers' perceptions is the dependability and speed of card readers 113. Ideally, a patron inserts a magnetic identity card 160 into card reader 113 to initiate tracking and forgets about it until magnetic card 160 is removed, terminating bet tracking. However, casino environments are very busy and gaming tables are bumped and otherwise disturbed regularly. For this reason, standard card readers are not sufficiently dependable, since they may, if bumped, terminate a patron's betting session while the patron is still playing.

Figure 3:
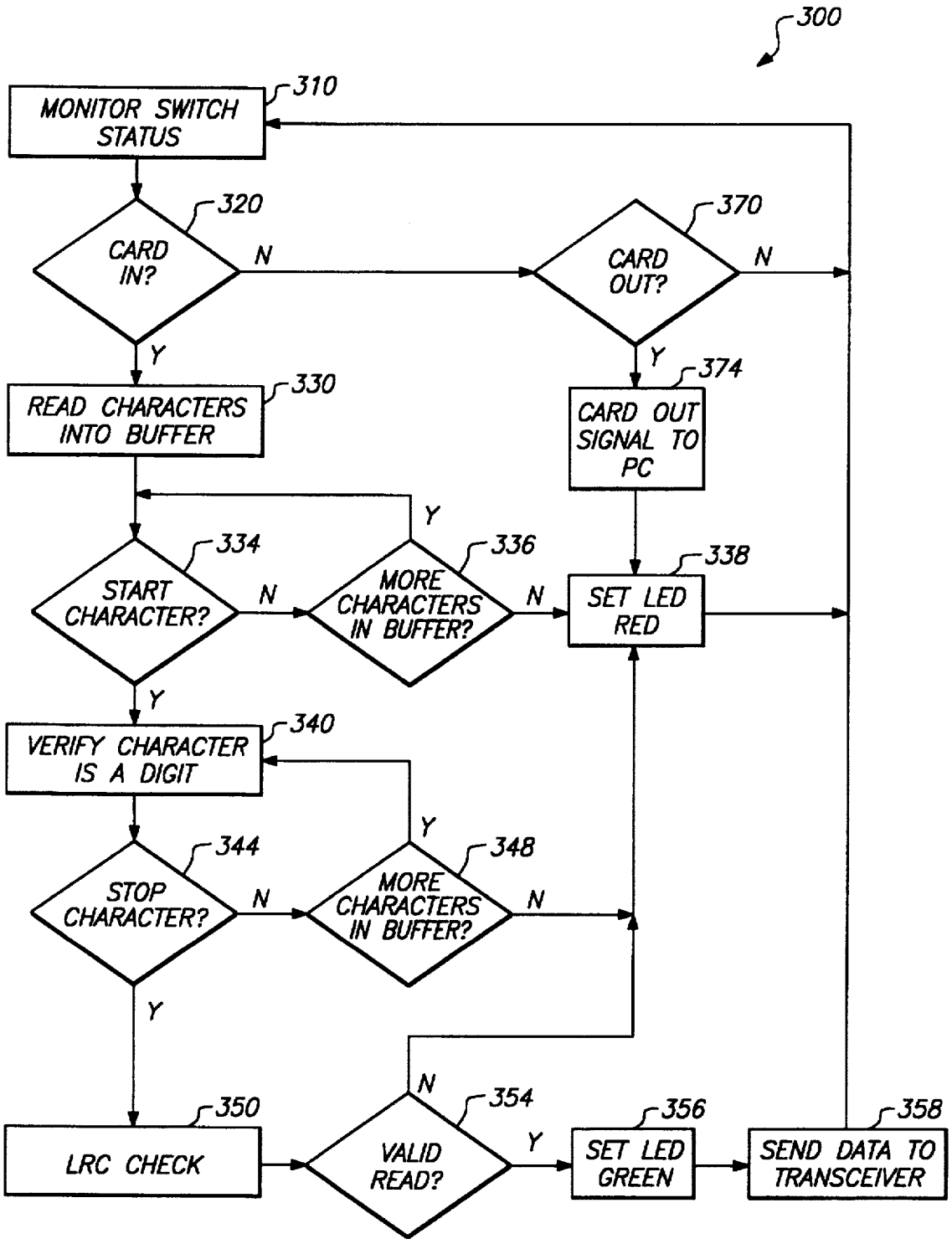
FIG. 3 is a flow chart of the method used to extract player information from magnetic cards using the card readers of FIG. 1B.

Referring now to FIG. 3, there is shown a flow chart of card reading process 300 for stable monitoring of patrons' betting activities. A microswitch monitors 310 card reader 113 for insertion or removal of a magnetic card 160. When a card-insertion is detected 320, characters are read 330 into a buffer from inserted card 160. Characters in the buffer are tested 334 sequentially until start sentinel 166 is identified among the read characters or until no characters remain in the buffer. If the start sentinel is not detected 334, process 300 branches 336 and sets 338 a red LED on card reader 113 indicating a failed read. When a start character is detected 334, process 300 verifies 340 that each succeeding character is a digit between 0 and 9 and checks 344 for end sentinel 168. If end sentinel 168 is not detected 344 and no more characters remain 348 in the buffer, the red LED is set 338 to indicate a failed read. When end sentinel 168 is detected 344, the read characters between the start and end sentinels 164, 168 are checked 350 using longitudinal redundancy check (LRC) character 169 or any comparable parity checking method. If no errors are identified 354, process 300 activates 356 a green light on card reader 113 and sends 358 the identity code 164 to transceiver 116. If errors are detected 354, the red LED is set 338 to indicate to the patron that the card must be reinserted.

When monitor step 310 detects 370 a card out process, whether it is intentional or a result of jostling card reader 113, a card out message is sent 374 to PC 142, the red LED is set 338, and process 300 returns to monitor step 310. The card-out message triggers computer system 140 to close an open bet record at the position corresponding to card reader 113. Typically, a bump to a card table 112 merely displaces a card momentarily so that when the card returns to rest, process 300 merely detects 320 the card-insert and reopens a betting record with no appreciable loss of tracking time.

Figure 4A:
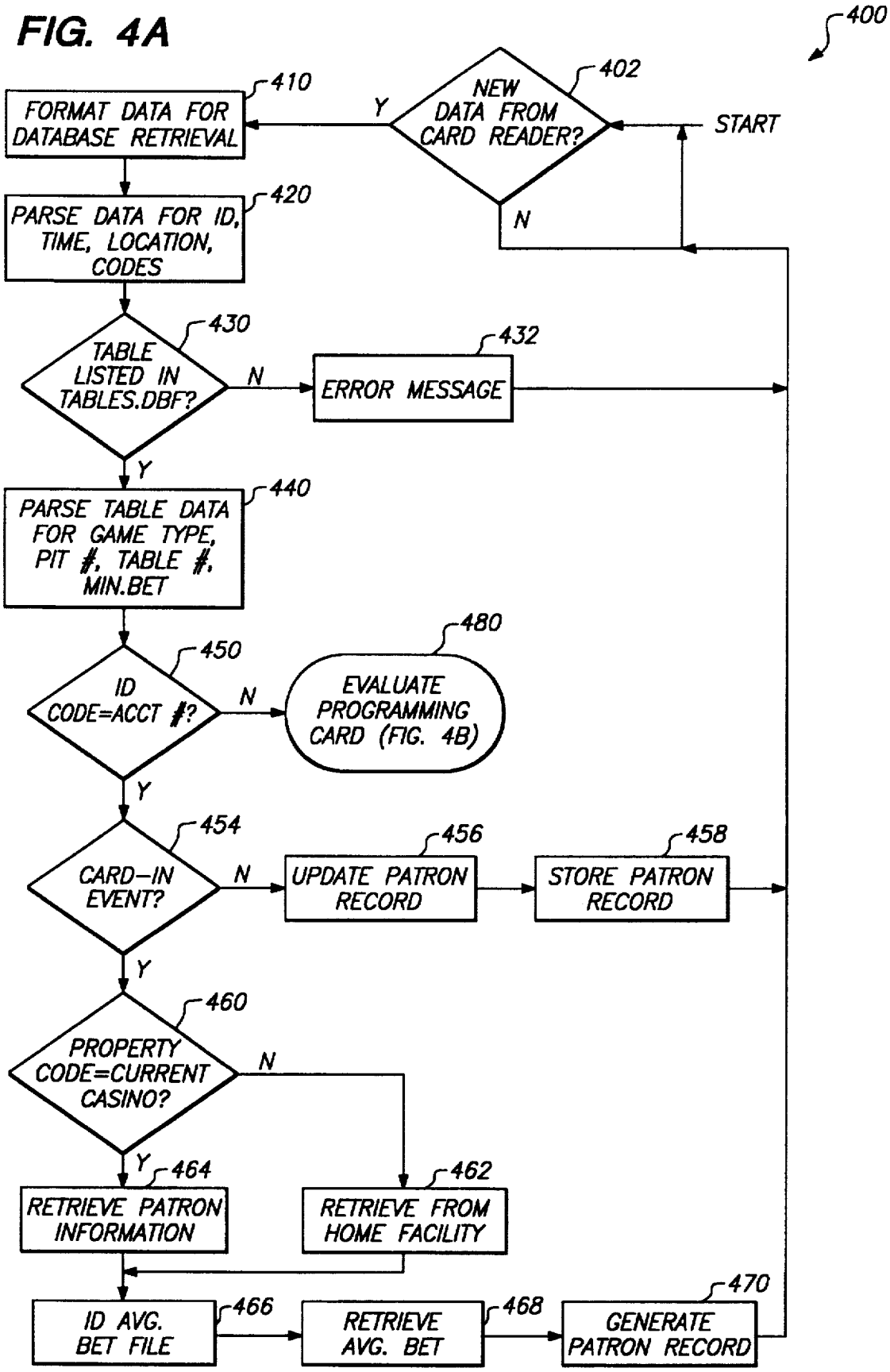
FIGS. 4A–4B are detailed flow charts showing the flow of information in the computer system of FIG. 1A.

Referring now to FIG. 4, there is shown a detailed flow chart of an information handling process 400 implemented by computer system 140 (FIG. 1A). Initially, process 400 waits 402 until new data is available from a card reader 113 (FIG. 1B), indicating that a player has either begun or ended a betting session. Received data is formatted 410 and parsed 420 to determine the time of the event (time code), whether the event was a card in or card out event, the location of the event (location code indicating table number and position), the identity code, and the property code which is appended to the identity code. In the disclosed embodiment, first PC 142 formats 410 data from card readers 113 before transferring it to second processor 152 which parses 420 the formatted data and implements the data retrieval process described below.

Process 400 uses the parsed data to retrieve information on both the patron and the table at which the patron is playing. First, the location code is checked 430 to determine whether it corresponds to a valid location, i.e. a table for which there is an entry in the tables data base (TABLES-.DBF). If it is not valid, an error message is sent 432 to an error file. If the location information is valid, information is retrieved 440 from TABLES.DBF identifying the game type, pit number, table number, and current table minimum bet at the patron's table.

The identity code is checked 450 to determine whether it corresponds to a valid patron account number or a programming card number, or if an error has been introduced during transmission. If the identity code corresponds to the account number of a casino patron, the data parsed in step 420 is checked 454 to determine whether the new data was triggered by a card-in or card-out event. For a card-in event, information on the patron is retrieved 464 from a patron data base. In the preferred embodiment, patron account numbers include a property identifier to indicate the home casino at which the patron normally plays. If the indicated property differs 460 from the current casino, the patron information is retrieved 462 by remote access to the indicated property. This eliminates the need to maintain complete sets of files for all casino patrons at each casino facility.

When a card-out event is detected at step 454, the time code from step 420 is used to update 456 an outstanding patron record, and the record is stored 458 in the patron data base, indexed by the patron's account number.

In order to generate a rating for a patron, process 400 determines a patron's average bet using the current table minimum bet for the patron's table and the time of play. In the preferred embodiment, the current table minimum bet from step 440 identifies 466 an average bet file AVGXXX.DBF, where XXX corresponds to one of the table minimum bets, 003, 005, 010, 025, 050, or 100 dollars. The entries of AVGXXX.DBF are average bets indexed according to the time of day and the day of the week. The average bet entry appropriate to the period of the patron's play is retrieved 468 using the time code, and a patron record based on the average bet, an estimated rate of play, and the duration of a patron's play is generated 470. System 100 also allows casino personnel to manually enter an average bet for a patron, if the patron's betting differs significantly from the average bet value being used.

A patron's betting record, which is made available to casino personnel through local terminals 150, 152, preferably includes all betting activity by the patron at any of the facility gaming tables during a selected period. Typically, data for the preceding 24 or 48 hours is maintained in a quick access file while data for less recent betting periods are stored in the patron information file. The data record created includes a rating determined as follows:

$$\text{rating}=(\text{current avg. bet})\cdot(\text{rate of play})\cdot(\text{time code(in)}-\text{time code(out)})\cdot(\text{hold}).$$

Here, the rate of play is an estimated average number of plays per hour for the game being played at the patron's table and the hold represents the fraction of the money bet that is won by the casino for a particular game. The rate of play and the hold are estimated for each type of game are stored in computer system 140 for calculating ratings. The rating represents a theoretical win for the casino based on the time of play and betting level of a patron.

Patron ratings may be determined at different times. For example, a patron rating may be determined whenever the patron removes his or her magnetic card from card reader 113, using the time codes generated by the card insertion and removal events to calculate the elapsed time. Alternatively, card readers 113 may be polled periodically to determine an elapsed time between a card insertion event and the time the polling occurs. In this case, step 402 of FIG. 4 is triggered each time a card reader 113 is polled. This allows a patron's rating to be updated to reflect accumulated betting time during each polling period, while play is still in progress.

Local terminals 150, 152 also display a current average bet, check-in time, table and table position for the current betting session of each player. This allows casino personnel to monitor in real time the betting activity of patrons at their tables, retrieve records of recent betting activity from a quick access file, and provide complementary benefits, such as free drinks, meals, or accommodations, based on accurate tracking data.

An alternative but more complex means for tracking a patron's bets entails the use of specially marked casino chips which can be monitored by electronic or video means from a remote location. Such means are known in the art and provide a more accurate account of a patron's betting activity, since exact bets can be provided to a patron's betting record instead of the estimate provided by steps 466, 468. However, remote monitoring means are also substantially more expensive than the estimation method used in the disclosed embodiment of the invention.

Figure 4B:
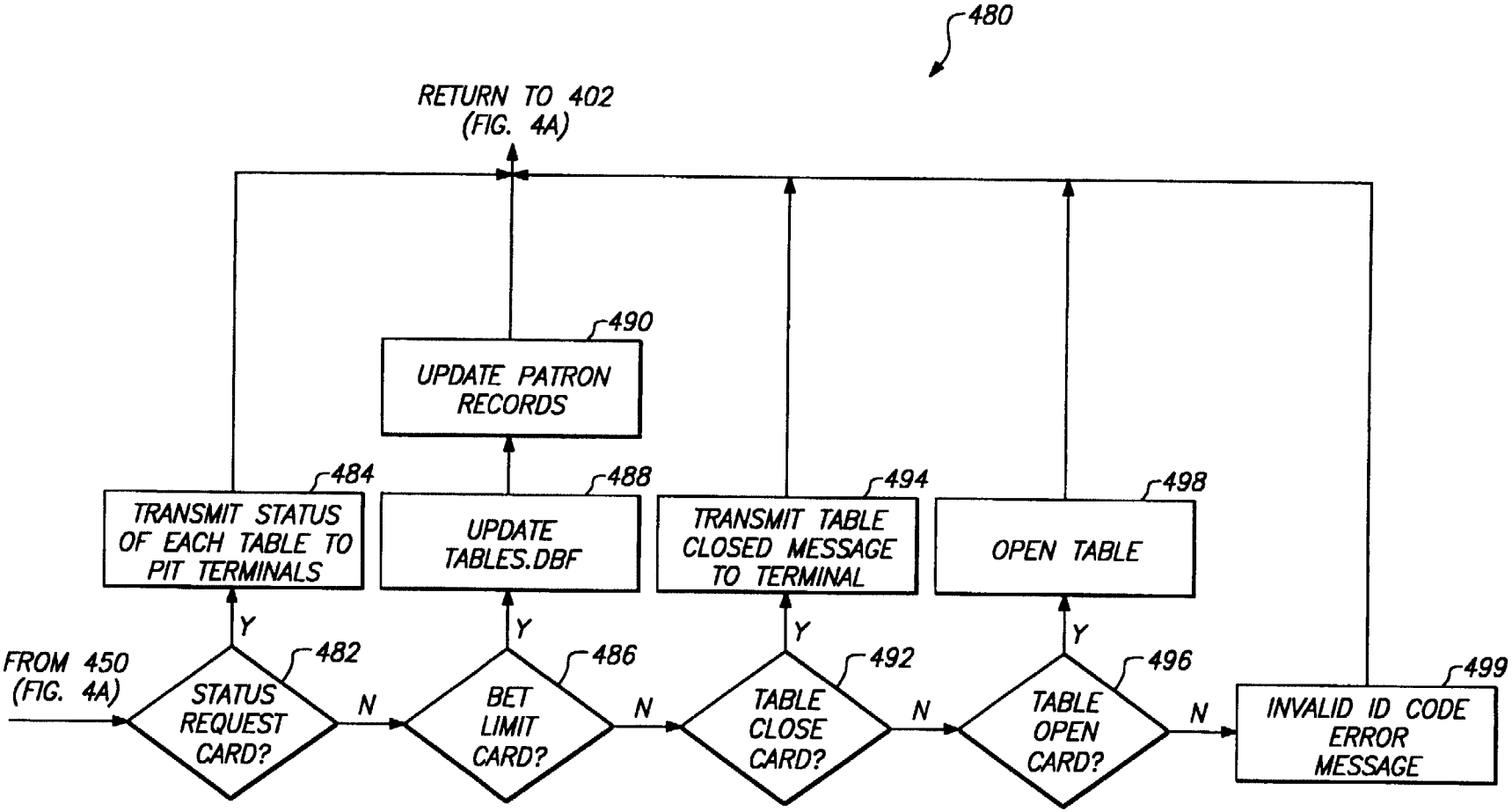

Referring now to FIG. 4B, there is shown a branch 480 of process 400 that is accessed when at step 450 (FIG. 4A), the identity code does not represent a patron account number. For example, if process 400 detects an invalid patron account number, the number is checked 482 to determine whether the data packet was triggered by insertion of a status request card. If so, process 400 transmits 484 a status report for each table to remote terminals 150, 152. If the identity code is not a status request identifier, it is checked 486 to determine whether it is corresponds to a bet limit, status, table open, or table closed programming card.

When process 400 detects 486 an identity code 164 corresponding to a bet limit card, the current table minimum bet listed in TABLES.DBF for the associated table is adjusted 488 to the amount indicated on the bet limit card. The bet records of patrons at the table are then updated 490 and monitoring resumed. If the identity code does not correspond to a table status card or bet limit card, it is checked 492 to determine whether the data packet was initiated by insertion of a table close card. A table-close card is inserted to indicate to system 100 that the corresponding table is closed. If the identity code corresponds 492 to a table close card, a table closed message is transmitted 494 to local terminals 150, 152. Likewise, if identity code 164 corresponds 496 to a table-open card, the status of the effected table is changed to open in computer system 140. When the identity code does not correspond to any of these cards, an error message is sent 499 to an error tracking file.

Thus, a method and system have been presented for automatically tracking the betting activity of card players at gaming tables and providing an indication of this betting activity to casino personnel in real time. Casino patrons use magnetic cards to check themselves in and out of the bet tracking system through magnetic card readers located at each betting position of a gaming table. The card readers couple customer identity and location codes through a wireless communication network to a computer system, which uses the codes to retrieve customer and gaming table information from data bases. This information is used to estimate a bet rating for the customer, which is made available to casino personnel at the customer's gaming table through the casino computer system. The rating is updated periodically to reflect the customer's accumulated betting activity.

What is claimed is:

1. A system for automatically rating betting activity of a casino patron at a gaming table, the system comprising:

a machine-readable card for storing an identity code assigned to a casino patron;

a card reader associated with a position at a gaming table, for reading the identity code from the machine-readable card when activated by the machine readable card:

a communication system coupled to the card reader for transmitting to a computer system the identity code of the casino patron and a location code associated with the card reader; and the computer system including a memory having customer and gaming table data bases stored therein, for associating a time code with activation of the card reader and for retrieving information on the casino patron and the gaming table to generate a casino patron betting record based on the identity, location, and time codes.

2. The system of claim 1, further comprising a terminal coupled to the computer system for providing the casino patron betting record to casino personnel.

3. The system of claim 1, wherein the card reader is activated when the casino patron inserts the machine-readable card into the card reader or removes the machine-readable card from the card reader.

4. The system of claim 1, wherein the location code indicates the gaming table and the position at the gaming table with which the card reader is associated.

5. The system of claim 4, wherein the gaming table data base includes entries indexed according to location codes with each entry comprising a game type, a current minimum bet, and a gaming table number for the gaming table identified by the location code.

6. The system of claim 5, wherein the gaming table data base further comprises a data base of average bets having entries indexed to a minimum bet associated with a location code and the time code.

7. The system of claim 6, wherein the time code used to index average bets is further indexed according to the day and time of day at which the card reader is activated.

8. The system of claim 2, further comprising input means coupled to the terminal and to the computer system for manually entering an average bet rate at the terminal.

9. The system of claim 1, further comprising a means for altering the minimum bet entry in the gaming table data base.

10. The system of claim 9, wherein the minimum bet altering means comprises a machine-readable card on which is stored a bet change code that is coupled to the computer system through the card reader and communication system for triggering the computer system to adjust the minimum bet in the gaming table data base to a value indicated in the bet change code.

11. The system of claim 1, further comprising means for updating the betting record periodically.

12. The system of claim 11, wherein the updating means comprises a computer-implemented process for periodically polling the card reader to determine a player status and adjusting the player rating based on a current average bet and a time code.

13. The system of claim 1, wherein the card readers are mounted in a rail of the gaming table.

14. The system of claim 1, wherein the communication system is a wireless communication system.

15. The system of claim 14, wherein the wireless communication system comprises a transceiver connected to an output of the card reader for generating radio signals representing the identity and location codes and a relay transceiver for coupling the radio signals from the transmitter to the computer system.

16. A method for automatically rating betting activity of a casino patron at a gaming table, where the casino patron is identified by a machine-readable card, the method comprising the steps of:

associating a card reader with a player position at the gaming table;

providing a data base including casino patron and gaming table information in a computer system coupled to the card reader;

retrieving information on the casino patron and the gaming table from the data base responsive to activation by the machine-readable card of a card reader at the gaming table; and determining a rating for the casino patron from the retrieved gaming table information.

17. The method of claim 16, further comprising the step of transmitting the rating and casino patron information to casino personnel through a terminal coupled to the computer system.

18. The method of claim 16, wherein the providing step comprises the substeps of:

compiling game type and minimum bet information for the gaming table and indexing the compiled game type and minimum bet information to a location code associated with the card reader;

compiling information on casino patrons and indexing the compiled information to an identity code on the machine readable card of the casino patron.

19. The method of claim 16, wherein the retrieving step comprises the substeps of:

accessing the casino patron information with the identity code;

determining the location code from the card reader activated by the machine-readable card; and accessing the gaming table information based on the determined location code.

20. The method of claim 19, wherein the determining step comprises the substeps of:

generating a data base of average bets indexed by a minimum bet and a time of play;

determining a minimum bet from the retrieved gaming table information;

determining the time of play from a signal provided when the card reader is activated by the machine readable card; and retrieving an average bet from the average bet data base using the minimum bet and time of play.

21. The method of claim 20, wherein the determining step further comprises the substep of calculating a theoretical win from a product of the average bet, a rate of play, an elapsed time, and a hold value.

22. The method of claim 21, wherein the rate of play and hold value are selected according to the type of game being played at the gaming table.

23. The method of claim 21 wherein the substep of calculating a theoretical win occurs when a signal indicating deactivation of the card reader by the machine readable card is detected and the elapsed time is determined by a time difference between receipt of the signals indicating activation and deactivation by the machine readable card.

24. The method of claim 21, wherein the substep of calculating a theoretical win further comprises the substeps of:

polling the card readers to determine whether a casino patron is still playing at the location associated with the card reader;

determining the elapsed time since receipt of the signal indicating of the card reader by the patron's machine-readable card;

calculating a new theoretical win; and updating the rating with the new theoretical win.

25. A gaming table for tracking betting activity of casino patrons through machine-readable cards issued to the casino patrons and a computer system including data bases of casino patrons and gaming table information, the gaming table comprising:

a playing surface;

a card reader for reading data from the machine-readable cards, the card reader having an input for accepting a machine-readable card and an output for accessing the data read from the machine-readable card, and being associated with a location at the playing surface to define a playing position at the gaming table; and data coupling means electrically connected to the output of the card reader, for coupling data read from a machine-readable card to the computer system in order to retrieve casino patron and gaming table information from the computer system.

26. The gaming table of claim 19, further comprising an associated computer terminal coupled to the computer system for providing the retrieved casino patron and gaming table information to casino personnel.

* * * * *

UNITED STATES PATENT AND TRADEMARK OFFICE

CERTIFICATE OF CORRECTION

PATENT NO. : 5,613,912

DATED : March 25, 1997

INVENTOR(S) : Timothy J. Slater

It is certified that error appears in the above-indentified patent and that said Letters Patent is hereby corrected as shown below:

Claim 1, column 8, line 8, delete ":" and insert --;--.

Claim 26, column 10, line 46, delete "19" and insert --25--.

Signed and Sealed this

Fifteenth Day of July, 1997

*Attest:*

*Attesting Officer*

BRUCE LEHMAN

*Commissioner of Patents and Trademarks*